US005265550A

United States Patent [19]

Harper, Jr.

[11] Patent Number: 5,265,550

[45] Date of Patent: Nov. 30, 1993

[54] WATER VESSEL

[76] Inventor: William H. Harper, Jr., 1454 Amon Dr., Richland, Wash. 99352

[21] Appl. No.: 952,566

[22] Filed: Sep. 28, 1992

[51] Int. Cl.[5] ..... B63B 1/00

[52] U.S. Cl. ..... 114/61; 114/283

[58] Field of Search ..... 114/61, 283, 123, 285, 114/286, 362; 440/6, 7

[56] References Cited

U.S. PATENT DOCUMENTS 3,116,708 1/1964 Gardhouse ..... 114/61
3,981,259 9/1976 Harper, Jr. ..... 114/61
4,993,341 2/1991 Merkel ..... 114/362

*Primary Examiner*—Edwin L. Swinehart

*Attorney, Agent, or Firm*—Cahill, Sutton & Thomas

[57] ABSTRACT

A Water borne vessel is supported by a pair of laterally extendible pontoons, which pontoons are extended as a function of both speed and water conditions. A combination of extensible hydraulic cylinder units and threaded shafts selectively provide control of the degree of extension or retraction of the pontoons and maintenance of the pontoons at the selected position of the pontoons and a synchronizing device maintains movement of the pontoons in concert. The configuration of the asymmetric pontoons provides different width immersed surfaces and different wetted areas as a function of the degree of extension to accommodate speed, water conditions, wind and draft for optimum travel.

19 Claims, 7 Drawing Sheets

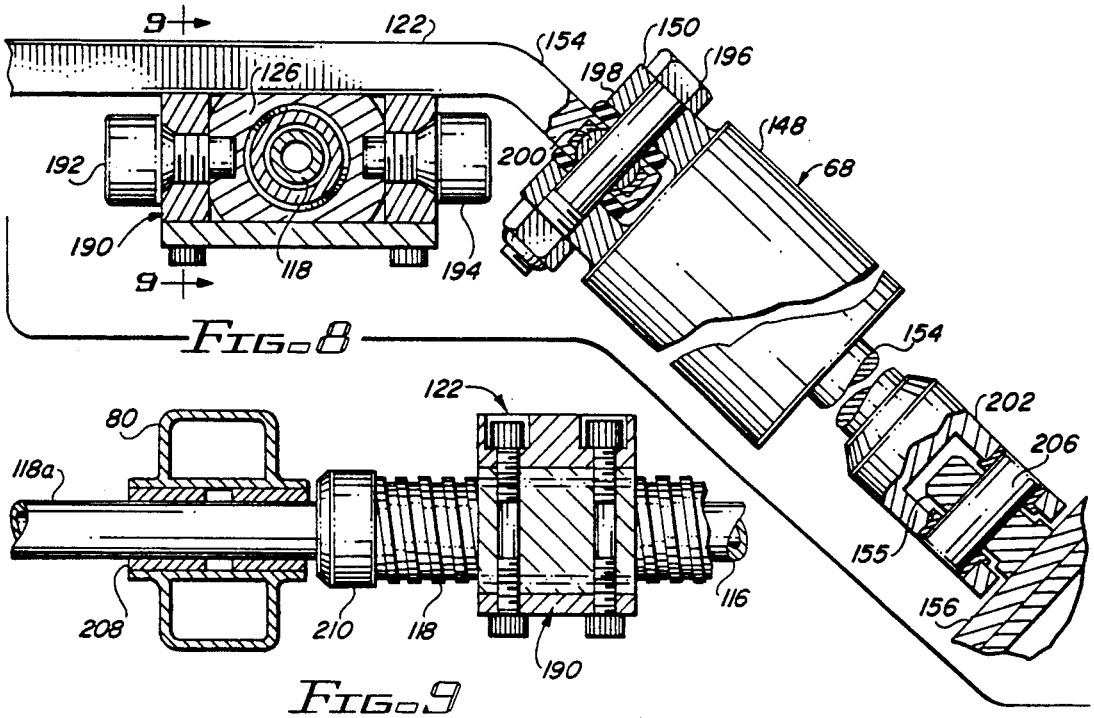
FIG. 8
FIG. 9
FIG. 10
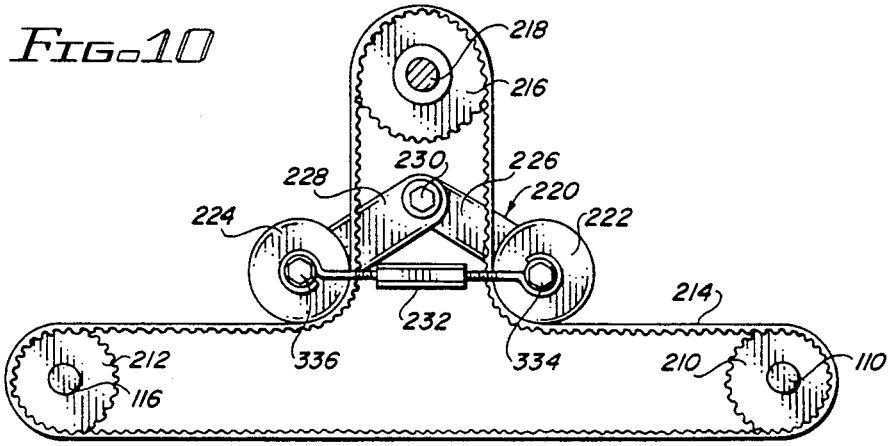
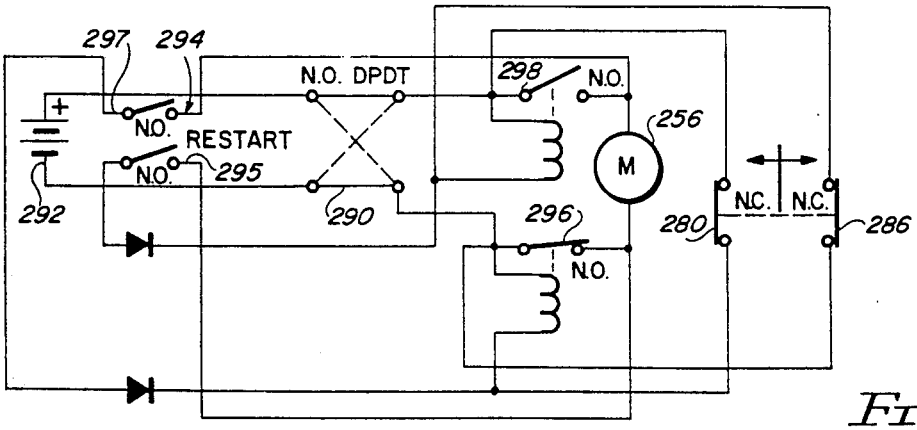
FIG. 14

20
408
404
14
406
409
18
402
26
24
23

20
14
412
408
404
414
414
18
410
409
406
402
24
23

20
14
424
408
420
404
412
414
416
18
409
406
418
410
402
422
24
23

WATER VESSEL

BACKGROUND OF THE INVENTION

1. Field of the Invention

The present invention relates to water vessels and, more particularly, to apparatus for extending and retracting the pontoons of a catamaran.

2. Description of Related Art

U.S. Pat. No. 3,981,259 describes and illustrates a catamaran having pivotally attached pontoons, which pontoons are of relatively conventional configuration. A pair of jack screws operating in concert provide incremental extension and retraction of the pontoons while hydraulically actuated cylinder and piston elements provide extension and retraction as a step function.

Pontoons are broadly divisible into categories of symmetric and asymmetric configurations signifying curvature in the horizontal plane of the side walls as being mirror images or non mirror images of one another. Depending upon whether the pontoons are primarily vertically oriented during use or heeled during use, symmetric or asymmetric pontoons provide the preferred stability, flotation and tracking. Moreover, the extent and degree of wave motion anticipated under normal use has an impact upon the preferred design configuration.

SUMMARY OF THE INVENTION

A pair of asymmetric pontoons are pivotally mounted to the frame of a water borne vessel. A two stage retraction and extension apparatus pivotally locates the pontoons to present a wetted area specifically configured to accommodate high seas, planing or shallow draft. Furthermore, the apparatus relocates the hulls to accommodate vehicular size restrictions for trailering the vessel on land. A synchronizing apparatus, acting directly upon the pontoons, ensures pivotal movement in concert.

It is therefore a primary object of the present invention to provide a catamaran having pivotally mounted pontoons to accommodate a variety of speeds and water conditions.

Another object of the present invention is to provide apparatus for selectively pivotally locating the pontoons of a catamaran at preselected positions.

Yet another object of the present invention is to provide apparatus for pivotally moving pontoons of a catamaran in concert.

A further object of the present invention is to provide control apparatus for directing pivotal movement of the pontoons of a catamaran.

A yet further object of the present invention is to provide asymmetric pontoons for a catamaran adapted to sea conditions and speed as a function of the angular position of the pontoons.

A still further object of the present invention is to provide apparatus for pivotally locating a pair of pontoons of a catamaran for stability under rough sea conditions, for high speed or for shallow draft.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which:

FIG. 8 is a partial view taken along lines 8—8, as shown in FIG. 6;

FIG. 9 is a partial view taken along lines 9—9, as shown in FIG. 8;

FIG. 10 illustrates apparatus for driving a pair of rotatable shafts shown in FIG. 6;

FIG. 14 is a schematic for the control circuitry of the power module;

DESCRIPTION OF THE PREFERRED EMBODIMENT

Figure 1:
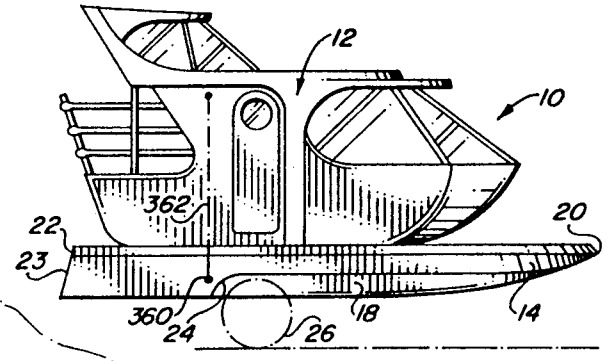
FIG. 1 is a side view of a water borne vessel having pivotable pontoons.

FIG. 1 illustrates a catamaran 10 having a superstructure 12 mounted upon a pair of pivotally attached pontoons 14 and 16, of which pontoon 14 is illustrated in side view. As illustrated, pontoon 14 includes a lateral indentation 18 extending from a point proximate to bow 20 toward stern 22 and terminating at a downwardly curved surface 24. Wheel 26, illustrated in phantom lines, is representative of a wheel of a trailer (not shown) for supporting the catamaran for travel across land. The wheel extends into the indentation to accommodate maximum lateral location of the pontoons while conforming with regulations attendant the width of trailers towed on public roads.

Figure 2:
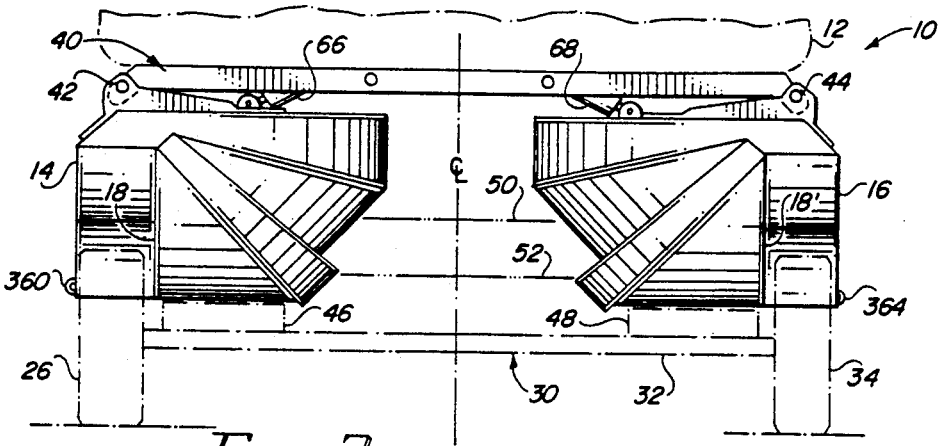
FIG. 2 is a partial front view illustrating the position of the pontoons during trailering and under minimal draft conditions.

Referring to FIG. 2 there is illustrated a front view of catamaran 10 mounted upon a trailer generally identified by reference numeral 30 and its reference line extending to axle 32 interconnecting wheels 26 and 34. A framework 40 interconnects superstructure 12 with pontoons 14 and 16. Pivot axis 42, 44 pivotally interconnect pontoons 14 and 16, respectively, with framework 40. As shown in FIG. 2, the pontoons are in the retracted position when the catamaran is mounted upon trailer 30. Support for the catamaran upon the trailer may be provided by bumpers 46, 48 representatively illustrated as extending upwardly from axle 32; it is to be understood that other fittings may be used in conjunction with straps, shackles or fittings to releasably secure catamaran 10 to trailer 30. As alluded to with respect to FIG. 1, pontoon 14 includes an indentation 18 for accommodating wheel 26 to permit the widest stance of trailer 30 for stability of purposes while accommodating maximum lateral displacement between the pontoons in the trailering configuration and yet conform with regulations attendant travel upon public roads. Pontoon 16 also includes an indentation 18 for accommodating wheel 34 for the same reasons.

The retracted position of pontoons 14 and 16, as illustrated in FIG. 2, also corresponds with one position of the pontoons when catamaran 10 is underway. Dashed line 50 depicts the waterline with respect to the pontoons while the catamaran is at rest in the water. When the catamaran is underway, dashed line 52 depicts the waterline with respect to the pontoons.

Figure 3:
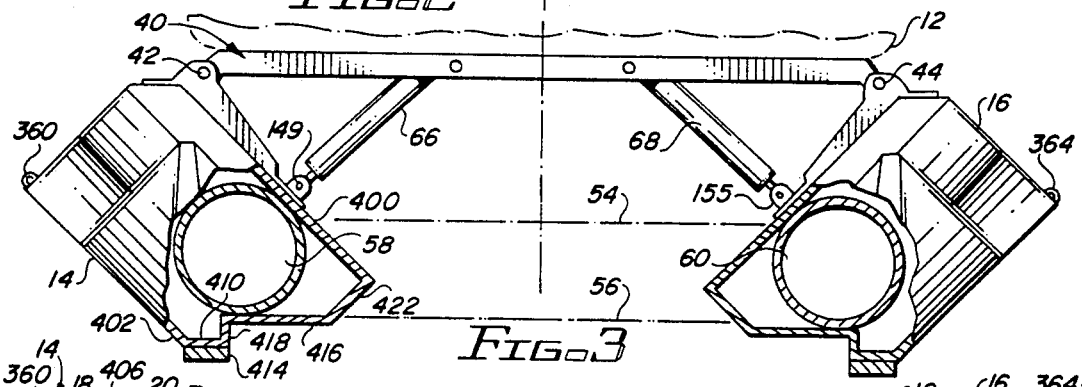
FIG. 3 is a partial front view illustrating the position of the pontoons at cruising speed.

FIG. 3 depicts partial extension of pontoons 14 and 16 when catamaran 10 is in the water. Dashed line 54 is representative of the waterline with respect to the pontoons when the catamaran is at rest. Dashed line 56 is representative of the waterline when the catamaran is operating at cruise speed. Since catamaran 10 is a powered vessel, fuel must be carried. As depicted in cutaway views of pontoons 14 and 16, fuels tanks 58, 60 may be located in each of the pontoons, as depicted. Because fuel is less dense than water and as the fuel tanks are almost never completely full, the fuel tanks also serve a secondary purpose as flotation devices in the event of puncture or damage of one or both of the pontoons.

Figure 4:
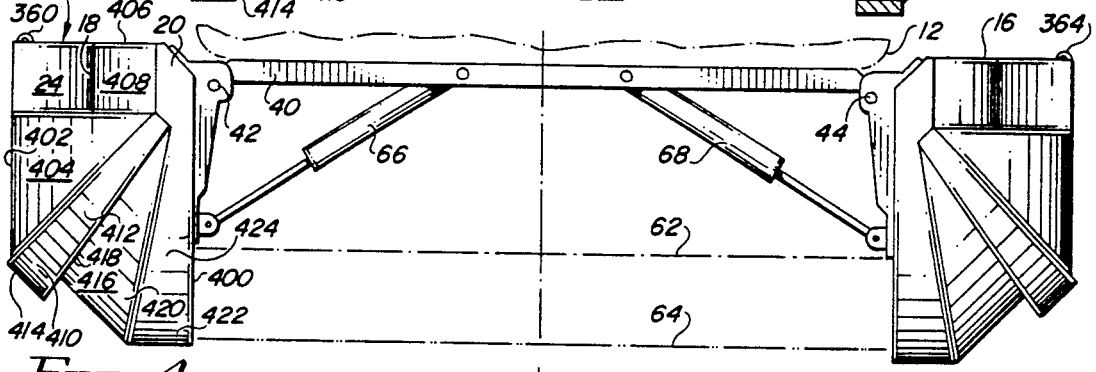
FIG. 4 is a partial front view illustrating the position of the pontoons for hydroplaning.

FIG. 4 illustrates pontoons 14 and 16 in the extended position. Dashed line 62 depicts the waterline when catamaran 10 is at rest and dashed line 64 depicts the waterline when the catamaran is travelling at hydroplaning speed. It may be noted that hydraulic cylinders 66, 68 are in their fully extended positions. In the position of the pontoons illustrated in FIGS. 2 and 3, hydraulic cylinders 66, 68 are in their retracted position.

Figure 5:
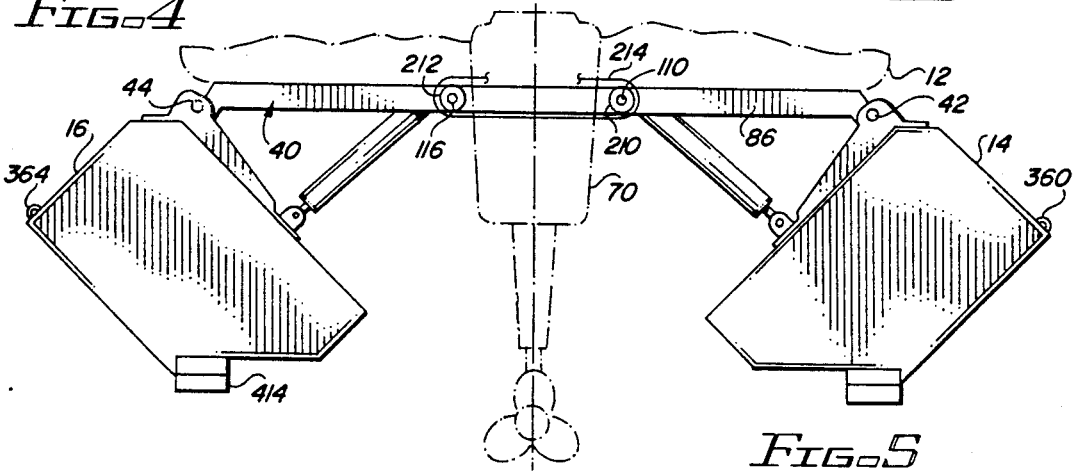
FIG. 5 is a partial rear view illustrating use of an outboard motor to propel the vessel.

FIG. 5 is a rear view of the pontoons and supporting framework 40. It depicts an outboard motor 70 in phantom lines attached to framework 40 at the stern by conventional supports and brackets. It is to be understood that a conventional inboard motor with drive shaft and propeller could be employed to provide motive power to catamaran 10.

Figure 6:
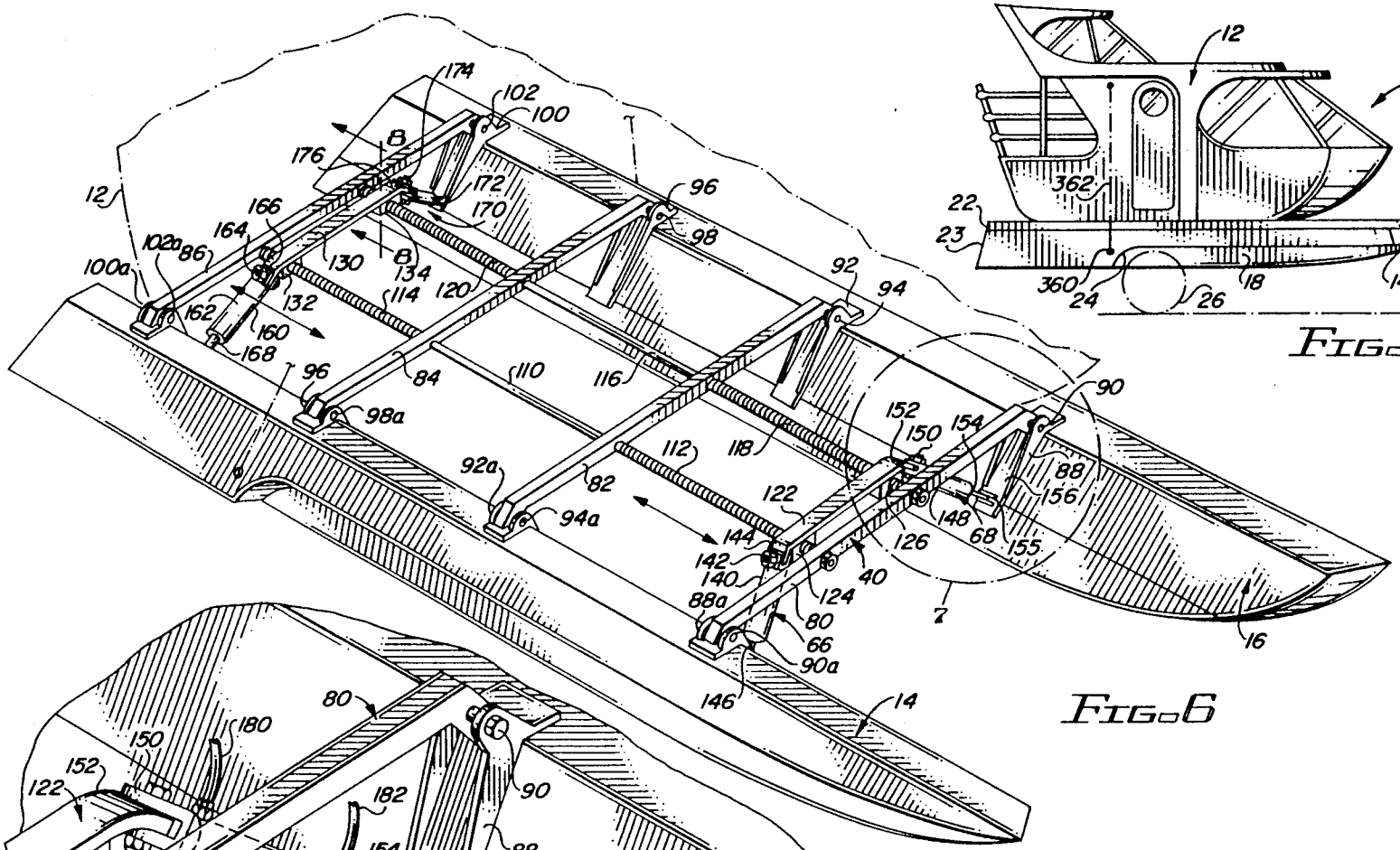
FIG. 6 illustrates the operative elements attendant repositioning of the pontoons.
Figure 7:
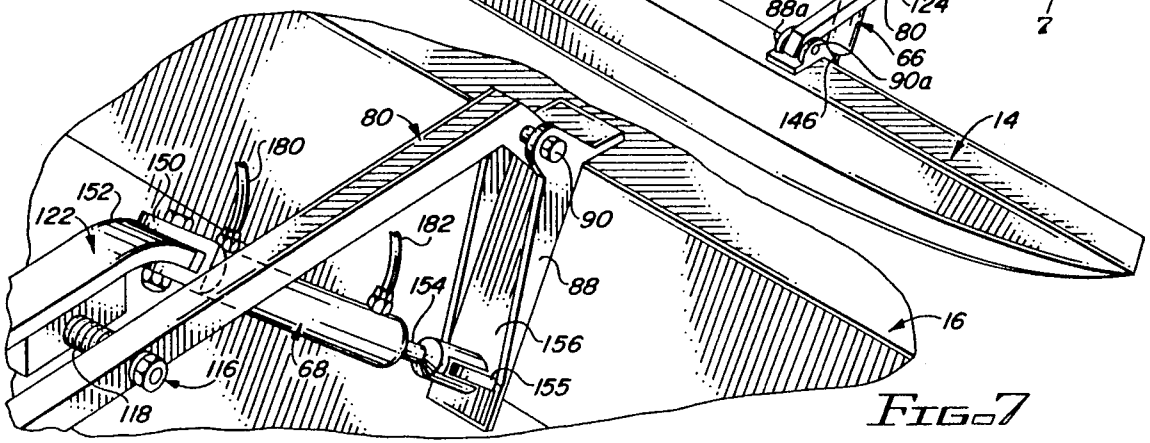
FIG. 7 is a partial view taken within circle 7 illustrated in FIG. 6.

Referring jointly to FIGS. 6 and 7, various of the apparatus for supporting, extending and retracting pontoons 14 and 16 will be described. Framework 40 (see FIGS. 2, 3 and 4) includes beams 80, 82, 84 and 86. A bell crank 88 secured to pontoon 16 pivotally interconnects one end of beam 80 with the pontoon through pivot means 90. A similar bell crank 88*a* is attached to pontoon 14 and interconnects with the other end of beam 80 through pivot means 90*a*. Bell cranks 92, 92*a* interconnect pontoons 16, 14 with opposed ends of beam 82 through pivot means 94, 94*a*, respectively. Bell cranks 96, 96*a* interconnect pontoons 16, 14 with opposed ends of beam 84 through pivot means 98, 98*a*, respectively. Bell cranks 100, 100*a* secure pontoons 16, 14 via pivot means 102, 102*a*, to opposed ends of beam 86, respectively. Pivot means 90, 92, 96 and 98 correspond with pivot axis 44 while pivot means 90*a*, 94*a*, 98*a* and 102*a* correspond with pivot axis 42, which pivot axis are depicted in FIGS. 2, 3, 4 and 5.

A first rotatable shaft 110 is journalled in beams 80, 82, 84 and 86. This shaft includes screw threads 112, 114 disposed between beams 80, 82 and 84, 86. A similar shaft 116 is rotatably journalled in beams 80, 82, 84 and 86. It also includes screw threads 118, 120 disposed intermediate beams 80, 82 and 84, 86. A bar 122 is supported upon shafts 110, 116 by threaded followers 124, 126 threadedly engaging screw threads 112, 118 of shafts 110, 116, respectively. A similar bar 130 is supported on shafts 110, 116 by threaded followers 132, 134 engaging screw threads 114, 120, respectively. Upon commensurate rotation of shafts 110, 116, bars 122 and 130 will be urged to travel in concert toward and away from one another depending upon the direction of rotation of shafts 110, 116. Hydraulic cylinder 66 includes a cylinder 140 attached by attachment means 142 to flange 144 of bar 122. Plunger 146 is attached to swiveled attachment 149 (see FIG. 3) of bell crank 90*a*. Similarly, cylinder 148 of hydraulic cylinder 68 is attached by attachment means 150 to flange 152 of bar 122 and plunger 154 is attached to swiveled attachment 155 of arm 156 of bell crank 88. Hydraulic cylinder 160 includes a piston 162 attached by attachment means 164 to flange 166 of bar 130 and plunger 168 is attached to a swiveled attachment at an arm of bell crank 100*a*. Hydraulic cylinder 170 includes a cylinder 172 attached by attachment means 174 to flange 176 of bar 130 and a plunger 178 attached to a swivelled attachment of an arm of bell crank 100.

As particularly illustrated in FIG. 7, attachment means 150 accommodates pivotal movement fore and aft of hydraulic cylinder 68 with respect to bar 122. Similarly, the attachment means between plunger 154 and arm 156 of bell crank 88 accommodates fore and aft pivotal movement of the plunger with respect to the bell crank. The corresponding attachment means for each of hydraulic cylinders 66, 160 and 170 are duplicative of the attachment means illustrated in FIG. 7 with regard to hydraulic cylinder 68. A hydraulic fluid line 180 conveys hydraulic fluid to the hydraulic cylinder to bring about extension of plunger 154. Hydraulic fluid line 182 conveys hydraulic fluid to the hydraulic cylinder to bring about retraction of the plunger. The remaining hydraulic cylinders have equivalent hydraulic fluid lines to permit extension and retraction on command of the respective plungers.

Referring jointly to FIGS. 8 and 9, there is shown further details attendant the interconnection between a bar, such as bar 122 and its supporting threaded shaft such as shaft 118. Threaded follower 126 may be captured within an enclosing bracket 190 extending from the bar. Set screws 192, 194 secure the threaded follower within the bracket. Attachment means 150 securing hydraulic cylinder 68 to flange 152 may include a bolt 196 serving in the manner of a pivot pin extending through clevis 198 of cylinder 148 and an aperture 200 at the end of flange 152. Plunger 154 may include a clevis 202 secured to swivelled attachment 155 extending from arm 156 by a pivot pin 206. As shown in FIG. 9, shaft 116 includes an end 116*a* journalled with beam 80 by journalling means 208. A collar 210, or the like, may be employed to positionally retain shaft 116 longitudinally with respect to the supporting beam.

Referring jointly to FIGS. 5 an 10, means for rotating shafts 110 and 116 will be described. An extension of shaft 110 rearwardly of beam 86 supports a sprocket 210. A similar sprocket 212 is supported upon an extension of shaft 116. A toothed belt 214 interconnects sprockets 210, 212 with a drive sprocket 216 secured to a drive shaft 218. A tensioning device 220 is formed by idler wheels 222, 224 rotatably mounted upon arms 226, 228, which arms are pivotally secured by a bolt 230. An adjustment mechanism 232 draws bolts 234, 236 supporting idler wheels 222, 224 toward or away from one another to provide the requisite tension upon belt 214 to prevent slippage.

Figure 11:
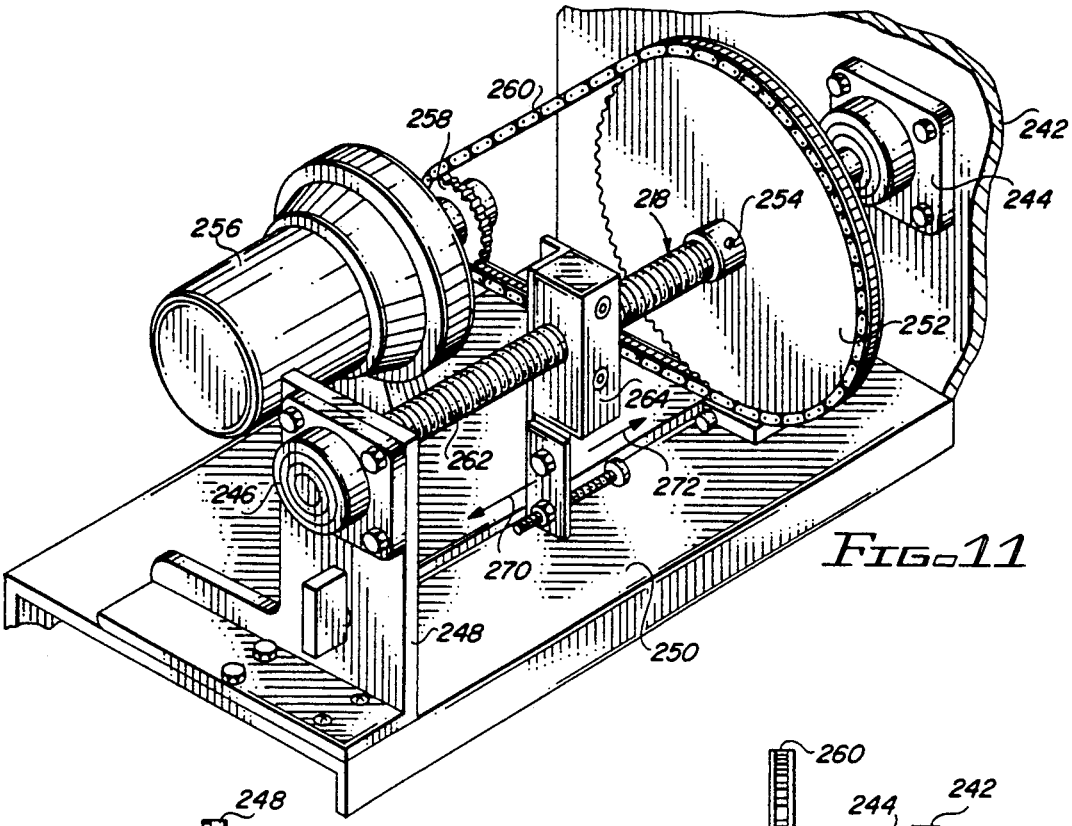
FIG. 11 illustrates a power module having limit switches for regulating the pontoon extension and retraction.
Figure 12:
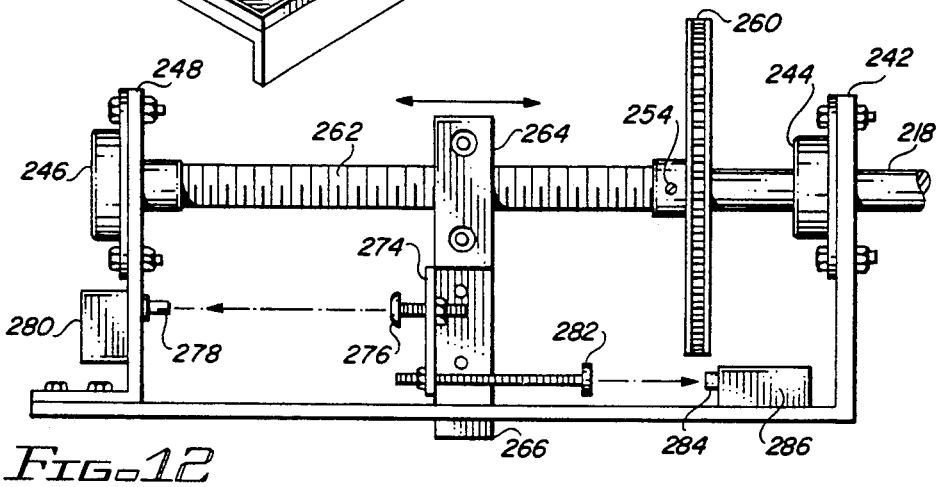
FIG. 12 is a side view of the power module shown in FIG. 11.
Figure 13:
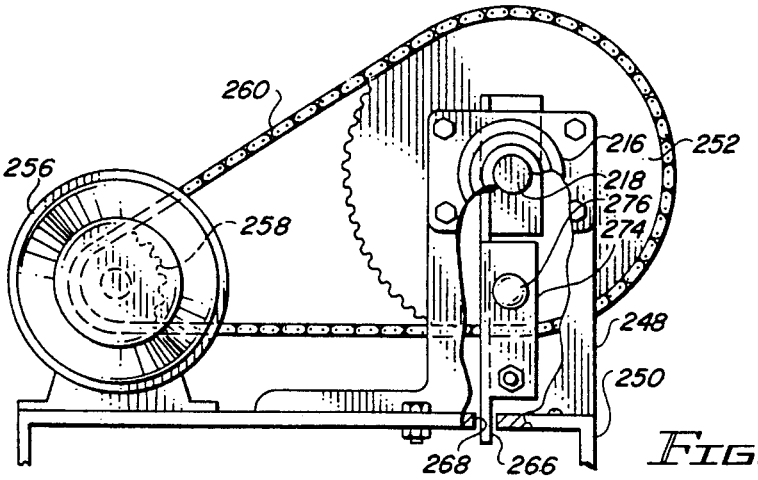
FIG. 13 is an end view of the power module show in FIG. 11.

Motive means 240 for rotating shafts 116, 118 is illustrated in FIGS. 11, 12 and 13. Shaft 218 extends through a bulkhead 242, or the like, attached to framework 40 and is journalled by a journal 244 attached to the bulkhead. The other end of the shaft is journalled by journalling means 246 supported by a wall member 248, or the like, extending upwardly from base 250, which base may be attached to a deck section of the framework. A sprocket 252 is secured to shaft 218 by a set screw 254 or the like. An electric motor 256 includes an output shaft supporting a drive sprocket 258. A chain 260 interconnects sprockets 252 and 258 to provide rotational movement to shaft 218 in response to energization of motor 256. Shaft 218 includes a screw thread section 262 supporting a threaded follower 264. The follower includes a downwardly extending key 266 translatable within a slot 268 in base 250; the key, in combination with the slot, prevents rotation of the follower upon rotational movement of screw thread section 262 of shaft 218. Accordingly, upon rotation of shaft 218, follower 264 will be caused to translate axially in one or the other direction, as depicted by arrows 270, 272. A support 274 extending from key 266 includes a positionally adjustable bumper 276 cooperating with push button 278 of an electrical limit switch 280 mounted upon wall member 248. A similar adjustable bumper 282 extends from support 274 and operates in combination with push button 284 of an electrical limit switch 286. Upon translation of follower 264 to the left, as indicated by arrow 270, bumper 276 will come into contact with push button 278 to actuate switch 280. Upon travel of the follower in the other direction (arrow 272), bumper 282 will contact push button 284 and actuate switch 286.

Referring to FIG. 14, there is illustrated an electrical schematic diagram depicting operation of motive means 256 illustrated in FIGS. 11, 12 and 13 for bringing about rotation of shafts 116, 110 on command. A double pole double throw (DPDT) switch 290 control the direction of rotation of motor 256. Power for the motor is provided by a battery 292. Upon depressing restart switch 294, motor 256 will rotate in one or the other direction. Assuming that the rotation of the motor causes rotation of shaft 218 in a first direction, bumper 276 will ultimately engage push button 278 and actuate switch 280. Switch 280 will open and further power to motor 256 will terminate.

A pair of alternately operating solenoid switches 296, 298 control the direction of rotation of motor 256. Upon inspection of the circuit it will be evident that switches 280, 286 are normally closed to permit operation of motor 256 in either direction until one of the limit switches, limit switches 280, 286 has been actuated. Thereafter, operation of the motor can occur only in the reverse direction until the actuated limit switch is deactuated.

Figure 15A:
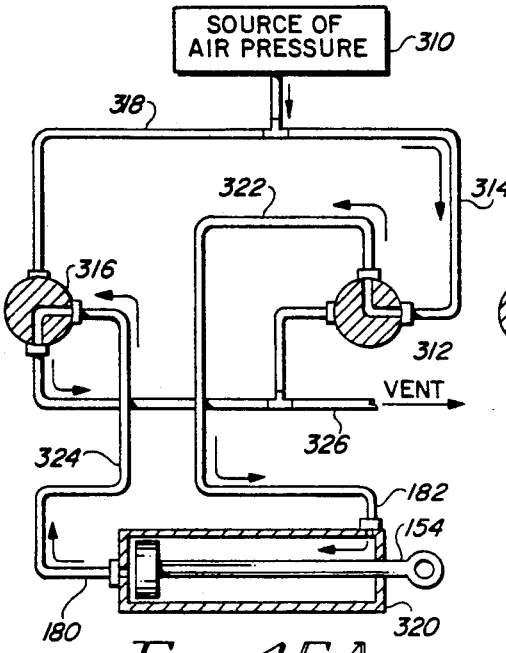
FIGS. 15*a* and 15*b* illustrate the hydraulic system for controlling operation of the hydraulic pistons.
Figure 15B:
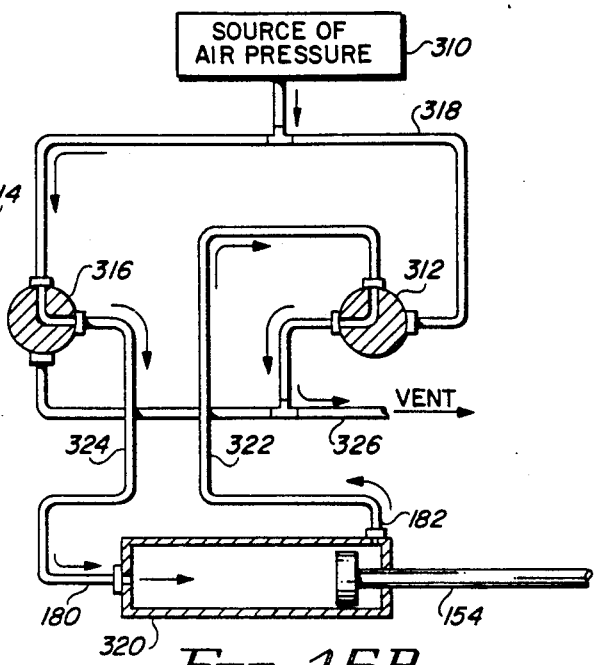

Referring to FIGS. 15*a* and 15*b*, there is described a hydraulic system for operating one or more of the hydraulic cylinders. In the embodiment illustrated, air pressure is the motivating fluid. It is to be understood that other gases or liquids could also be easily used. However, air pressure, including a source of air pressure, is particularly convenient since the air may be vented to the atmosphere instead of into a container or chamber. Air under pressure from a source of air pressure 310 is provided to valve 312 via conduit 314 and to valve 316 via conduit 318. To retract hydraulic cylinder 320, valve 312 is placed in the position shown. The air under pressure will be conveyed through valve 312 into conduit 322 to line 182 (see FIG. 7) of a hydraulic cylinder 320. The resulting air pressure within the cylinder of hydraulic cylinder 320 will cause plunger 154 to retract, as illustrated. The air expelled from within the hydraulic cylinder by the piston will be expelled into conduit 324, the expelled air will flow through valve 316 to exhaust conduit 326 for venting. To extend plunger 154, as depicted in FIG. 15*b*, valve 316 is rotated to the position shown (like valve 312 in FIG. 15*a*) and valve 312 is rotated to the position shown (like valve 316 shown in FIG. 15*a*). Upon setting of valves 312, 316 as depicted in FIG. 15*b*, air from source of air pressure 310 will flow through conduit 318 to valve 316, into conduit 324 and through inlet 180 (see FIG. 7) to act against the piston within hydraulic cylinder 320 to force plunger 154 to extend. The air previously existing within the hydraulic cylinder will be expelled by the piston through inlet 182 into conduit 322, through valve 312 into exhaust conduit 326.

It may be noted that repositioning either of valves 312, 316 from the configuration shown in either of FIGS. 15*a* or 15*b* will either isolate the source of air pressure from the valves or connect the source of air pressure to opposed ends of the hydraulic cylinder. In either event, the hydraulic cylinder will not be caused to be repositioned.

Figure 16A:
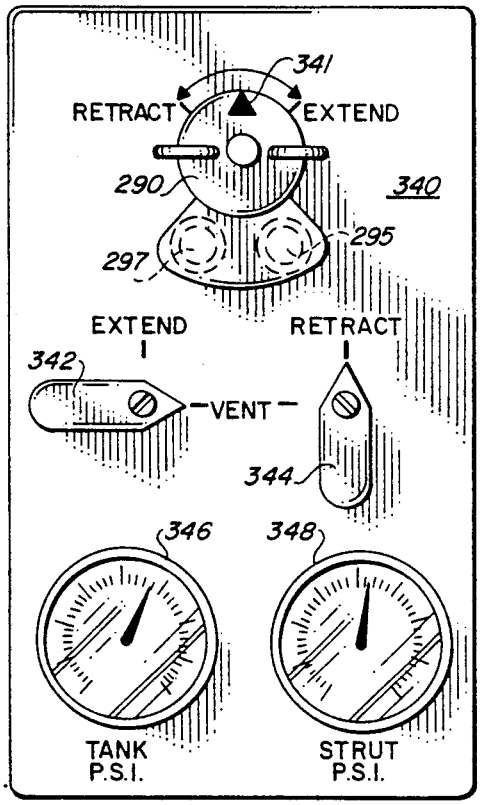
FIG. 16*a* and 16*b* illustrate the position of switches on a power panel for extending and retracting the pontoons.
Figure 16B:
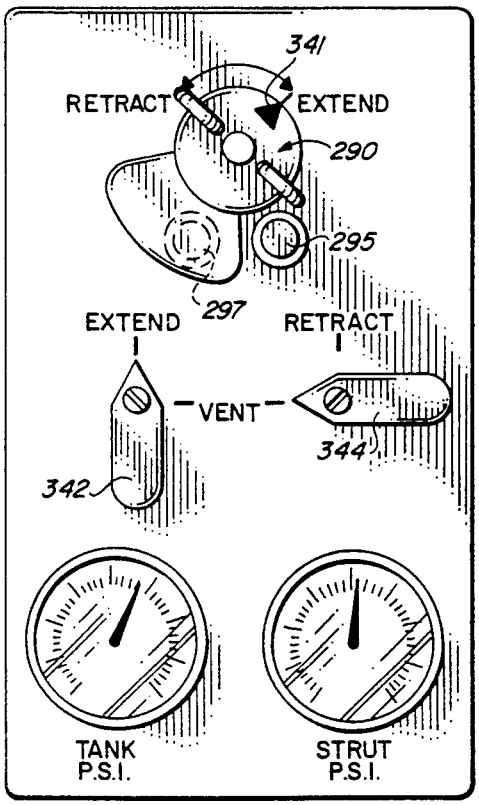

A representative control panel 340 is illustrated in FIGS. 16*a* and 16*b*. Manual switch 290 corresponds with the double pole double throw switch illustrated in FIG. 14. In the position indicated in FIG. 16*a*, neither extension nor retraction of the pontoons can be effected when pointer 341 is positioned between the retract and extend positions. Upon moving of switch 290 to the extend position, as illustrated in FIG. 16*b*, push button switch 295 is exposed. Upon pressing the push button switch, motor 256 (see FIG. 11) will be actuated and shafts 110, 116 will rotate resulting in translation of bars 122, 130. Upon moving switch 290 to the retract position, push button 297 will be exposed. Upon depressing the push button, motor 256 will be actuated in the reverse direction and shafts 110, 116 will rotate in the reverse direction and release the pressure on the respective one of switches 278, 284 (see FIG. 12). Such rotation of the shafts will cause bars 122, 130 to be translated in the opposite direction. Actuation of motor 256 can be stopped at any time by simply releasing switch 290. An internal spring causes the switch to return to the off position. In the event the bars are at the extreme retracted or extended position, and reflected by depression of either of push buttons 278 or 284 of respective limit switches 280, 286, further movement in such direction will not be possible. Restarting the motor in the opposite direction is accomplished by depressing the exposed switch 295 or 297.

Repositioning of valves 312, 316 (see FIGS. 15*a* and 15*b*) is effected by movement of handles 342, 344. To extend the hydraulic cylinders, handle 342 is rotated to the extend position, which corresponds with the position of valve 316 in FIG. 15*b*. Preferably concurrently therewith, handle 344 is repositioned to the vent position corresponding to the position of valve 312 shown in FIG. 15*b*. As noted previously, either valve may be rotated before the other without fear of damage to the equipment. To extend the hydraulic cylinders, handle 342 is rotated from the vent position to the vent position and handle 344 is rotated from the retract position to the vent position. Gauges 346, 348 may be incorporated to provide an indication of the pressure within the source of air pressure and at one or more of the hydraulic cylinders. It is to be understood that use of the term hydraulic has been in the generic sense and pneumatic cylinders are included within this term. Moreover, due to venting of the cylinders as the preferred embodiment pneumatic cylinders are preferable.

When pontoons 14, 16 are in the retracted position, as shown in FIG. 2, bars 122, 130 have been translated along threaded sections 112, 118 and 114, 120 of shafts 110, 116 to a location essentially adjacent beams 82, 84, respectively. To extend the pontoons initially, shafts 110 and 116 are rotated to cause translation of bars 122, 130 away from one another to a location essentially adjacent beams 80, 86, respectively, as illustrated in FIG. 6. Further extension of the pontoons is provided by actuating hydraulic cylinders 66, 68, 160 and 170 by operation of valves 312, 316 (as shown in FIG. 15*b*). The resulting position of the pontoons is depicted in FIG. 4. It may be noted that fine tuning of this position may be effected by selective rotation of shafts 110, 116 to relocate bars 122, 130 and incrementally retract or extend the pontoons, depending upon the degree of proximity of the respective bars with beams 80, 86.

Figure 19:
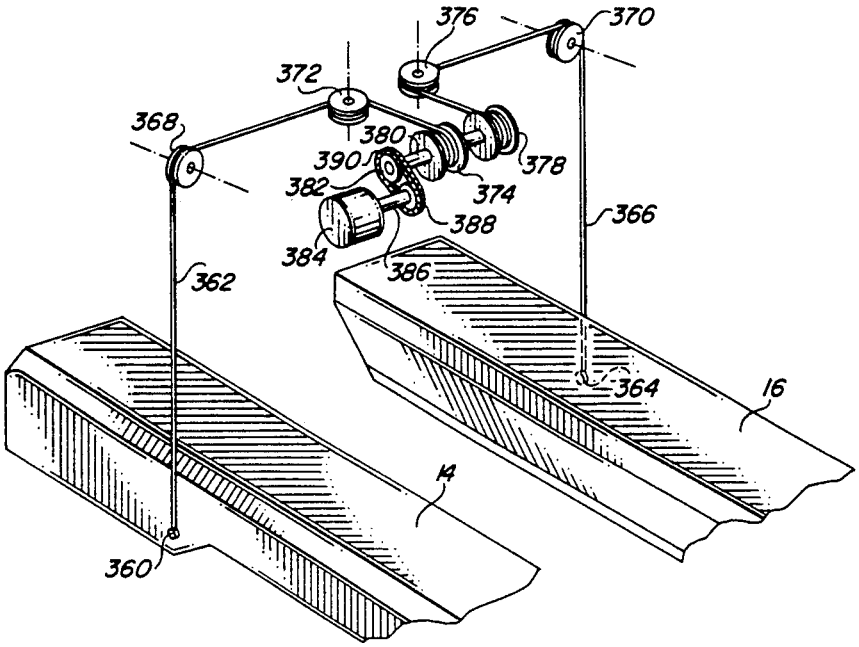
FIG. 19 illustrates the operative elements of the synchronizing apparatus.
Figure 17:
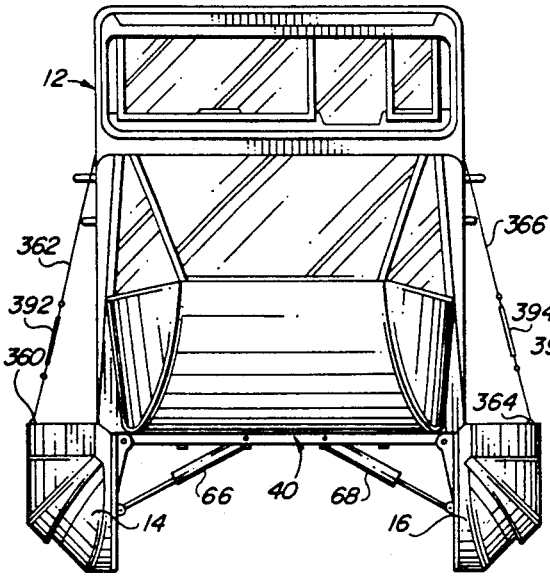
FIG. 17 illustrates a front view of the vessel incorporating apparatus for synchronizing pivotal movement of the pontoons.
Figure 18:
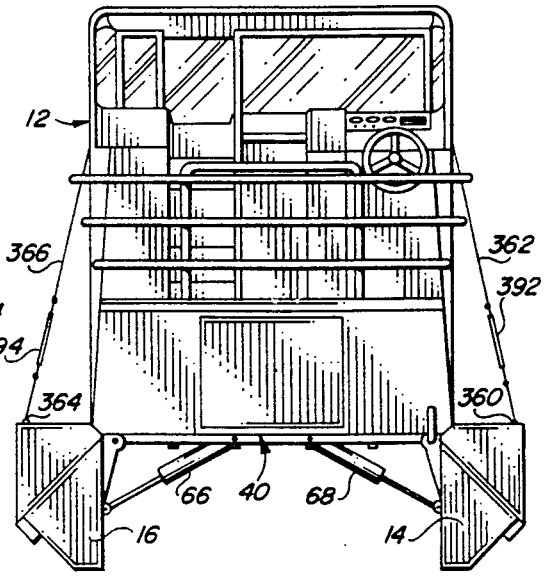
FIG. 18 illustrates a rear view of the vessel shown in FIG. 17.
Figures 20, 21, 22:
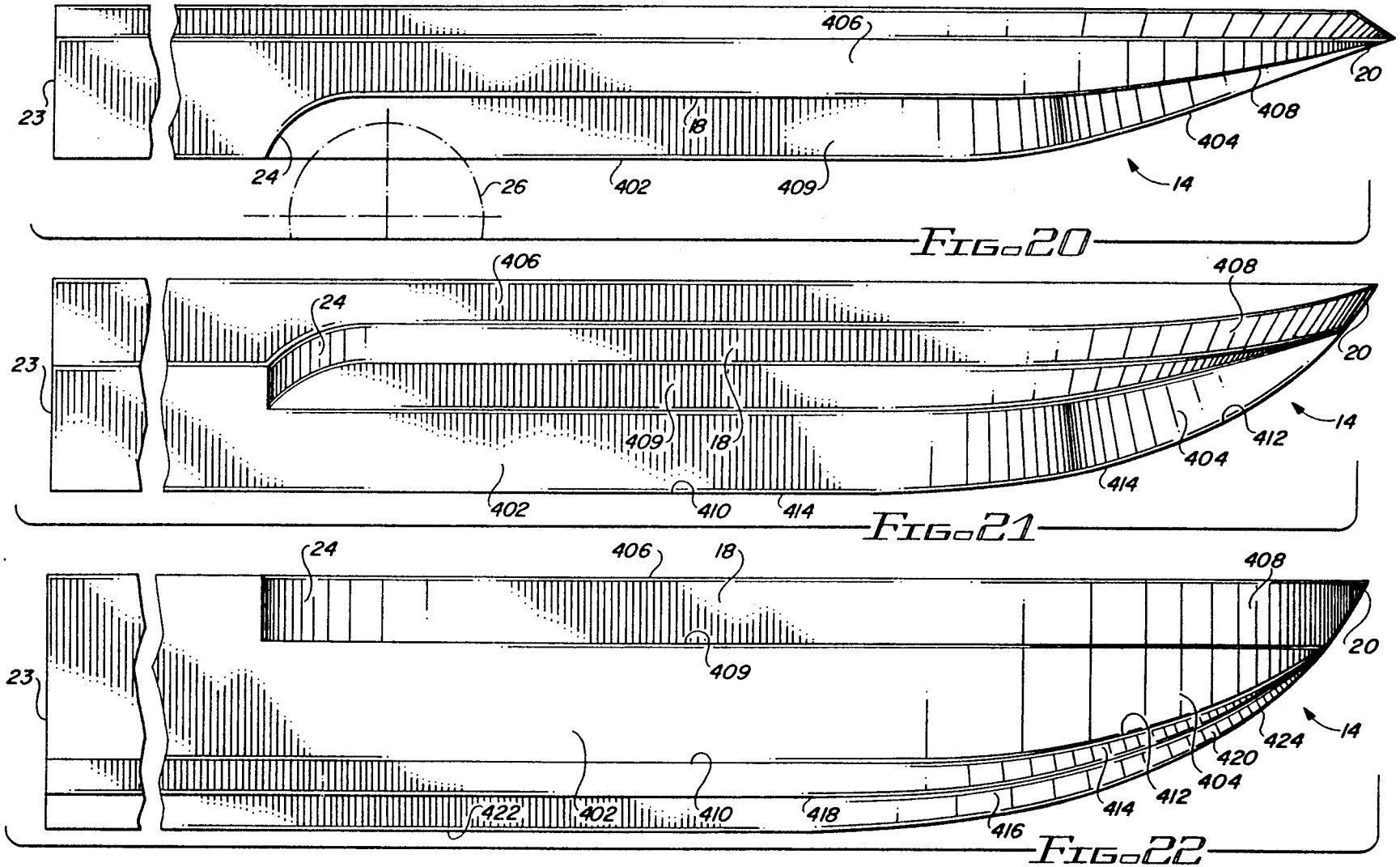
FIG. 20 illustrates a side view of a pontoon in the retracted position.
FIG. 21 illustrates a side view of a pontoon in the semi extended position.
FIG. 22 illustrates a side view of a pontoon in the extended position.

When extension/retraction of the pontoons is undertaken while the vessel is underway, it becomes important to ensure that the pontoons are extended and retracted in concert. Referring to FIGS. 17, 18 and 19, there is illustrated apparatus for maintaining pontoons 14 and 16 in concert during extension and retraction. A fixture 360 is located upon pontoon 14 to receive and secure the end of a cable 362. A similar fixture 364 is located on pontoon 16 to receive and secure the end of a cable 366. Cable 362 extends upwardly to superstructure 12 into engagement with a rotatably mounted pulley 368. Cable 366 extends similarly upwardly into engagement with a rotatably mounted pulley 370. A pulley 372 guides cable 362 onto a drum 374. A pulley 376 guides cable 366 onto to a drum 378. Drums 374, 378 are non rotatably mounted upon a rotatable shaft 380 supporting a sprocket 382. An electric motor 384 includes an output shaft 386 supporting a sprocket 388. A chain 390 interconnects sprockets 388 and 382. Cables 362, 366 may include length adjustment means 392, 394 to accommodate for tolerance variations.

Upon extension of pontoons 14, 16, motor 384 is energized to retract cables 362, 366 by wrapping them about drums 374, 378 at a rate essentially commensurate with the extension rate of the pontoons. Thereby, any lag in extension of one of the pontoons will be compensated by the force urged by the corresponding cable. Upon retraction of pontoons 14, 16, motor 384 is energized to permit unwinding of cables 362, 366 from drums 374, 378. The rate of unwinding is essentially commensurate with the rate of retraction to prevent one pontoon from retracting more rapidly than the other by the restraining force exerted by the commensurate cable. Since it is essentially impossible to obtain a rate of rotation of shaft 386 absolutely equal with the extension or retraction rate of the pontoons, sprocket 382 may include a clutch between the motor shaft and sprocket 382 to permit and accommodate for any such differences; furthermore, the clutch may be used to permit the cables to apply a substantial force to assure extension and retraction in concert.

The configuration of pontoon 14 will be described with reference to FIGS. 4, 20, 21 and 22. The pontoons are asymmetric, as such term is used by the cognizante. Each pontoon is formed by a plurality of surfaces, each of which surfaces is either planar or curved in a single plane. Canted surface 396 extending from the stern to bow 20 provides structural support for attachment of one of the legs of each of the bell cranks (90, 90*a*, 94, 94*a*, 98, 98*a*, 100, 100*a*) and includes a forward section 398 defining, in part, the bow. Inner surface 400 is essentially planar and interconnects longitudinally with the inside edge of canted surface 396. Surface 400 provides structural support for the remaining arms of the bell cranks. Surface 400 is planar with the non curved section of outer surface 402. Front section 404 of surface 402 is curved toward and terminates in proximity to bow 20. Surface 406 interconnects longitudinally with the outer edge of canted surface 396 and is essentially planar with depression 18 extending inwardly therefrom. Depression 18 is defined by a curved surface 24 (as discussed above) and a curved surface 408 terminating in proximity to bow 20 in conjunction with side wall 409. A strip 410 is adjacent the edge of surface 402 and set at an angle therewith with its forward section 412 being bent toward and terminating in proximity to bow 20. An additional strip of wood 414 or the like may be secured to strip 410 to serve as a wear element when the pontoons are in the position illustrated in FIGS. 3 and 21 in the event the vessel should run aground or be pulled up on the shore. It may be noted that strip 410 may be indented between the edge of surface 402 and side wall 418 to provide a longitudinally extending through for receiving and retaining a strip of wood 414 or other wear surface element. A surface 416, being connected to an edge of strip 410 by a side wall 418 includes a forward section 420 curved toward bow 20 and terminating in proximity therewith. A yet further surface 422 interconnects surface 400 with the edge of surface 416. It includes a forward curved section 424 extending toward and terminating in proximity to bow 20. An end plate 23 (see FIGS. 1, 20, 21 and 23) closes the rear of the pontoon.

Pontoon 16 is similarly configured with the cross sectional configuration described and illustrated, the wetted surface of the pontoons changes dramatically in area and configuration as a function of the degree of extension of the pontoons to provide the most efficient surface for the corresponding speed of the vessel. Furthermore, the degree of buoyancy necessary commensurate with the corresponding upward force exerted as a function of the speed of the vessel has been optimized. For example, for shallow draft purposes, the configuration illustrated in FIG. 2 is preferred in that such configuration places the broadest flattest surface of the pontoon lowermost and in contact with the water. During intermediate cruising speeds, strip 410 acts in the manner of a keel and yet the width of the pontoon which is a wetted surface has been reduced to reduce friction while providing the requisite supporting force commensurate with the speed of the vessel. For hydroplaning purposes, as illustrated in FIG. 4, a minimal width is presented to the water and side wall 418 in combination with strip 414 serves in the manner of a splash guard while also providing a small amount of upward force to the vessel. Vertical surface 400 serves in the manner of a stabilizing element during turns to assist in preventing skidding turns. Moreover, each configuration presented as a function of pontoon extension will offer a different type of performance for varying speeds, water surfaces and wave patterns. The configuration of the semi extended position will most probably be best suited for choppy, irregular water surfaces or when running at an oblique angle to the wind or wave pattern. The configuration of the non extended position or close to it will most probably be best suited for slow speeds, heavy loads and large or heavy wave conditions. It also provides the most shallow draft. The configuration of the fully extended position will most probably be the most efficient at high speeds with smooth water conditions. At low speeds in large waves or heavy seas, the fully extended position will help wave penetration and cause minimal pitching.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. Apparatus for varying the wetted surface of a water borne vessel, said apparatus comprising in combination:

a) a pair of pontoons, each pontoon of said pair of pontoons being asymmetrical on opposed sides of any longitudinal plane passing therethrough and including a plurality of longitudinally extending surfaces with certain ones of said surfaces having a planar section and a simple curvature curved section and the remaining ones of said surfaces being planar, each of said surfaces being set at an angle with respect to an adjacent one of said surfaces;

b) means for pivotally attaching each pontoon of said pair of pontoons to the vessel;

c) means for urging pivotal movement of each pontoon of said pair of pontoons about its respective attaching means to extend and to retract said pair of pontoons to place a selected one of said surfaces of each pontoon of said pair of pontoons lowermost in the water and present a unique wetted area as a function of the degree of extension of said pair of pontoons, said urging means including at least a pair of anchor points disposed upon the vessel associated with each pontoon of said pair of pontoons;

d) means for relocating said pairs of anchor points to modify the extension and the retraction of each pontoon of said pair of pontoons; and e) a source of power for actuating said relocating means to selectively relocate each of said pairs of anchor points as a function of the degree of extension and retraction of said pair of pontoons which relocation places a different one of said surfaces of each pontoon of said pair of pontoons as the lowermost surface in the water and thereby alters the wetted area to conform with the speed of the vessel and with the water surface condition.

2. The apparatus as set forth in claim 1 wherein said relocating means comprises a first jack screw associated with a first one of said pair of anchor points of one pontoon of said pair of pontoons and a second jack screw associated with a second one of said pair of anchor points of the other pontoon of said pair of pontoons and wherein said source of power comprises an electric motor and a chain drive interconnecting said electric motor with said first and second jack screws.

3. The apparatus as set forth in claim 2 including means for limiting the number of rotations of said first and second jack screws as a function of the degree of relocation of the respective ones of said pair of anchor points to afford control over the amount of extension and retraction of said pair of pontoons performable by said relocating means.

4. The apparatus as set forth in claim 1 wherein said urging means includes a plunger and piston assembly interconnecting a pontoon of said pair of pontoons with its respective one of said pair of anchor points.

5. The apparatus as set forth in claim 4 wherein one of said urging means is disposed between each anchor point of said pair of anchor points and the respective one of said pair of pontoons.

6. The apparatus as set forth in claim 1 including control means for actuating and deactuating said source of power and further control means for actuating said urging means.

7. The apparatus as set forth in claim 1 wherein said urging means includes a source of air pressure, pneumatic cylinder and piston assemblies, means for conveying air under pressure from said source of air pressure to each of said pneumatic cylinder and piston assemblies and means for selectively extending and contracting said pneumatic piston and cylinder assemblies in response to flow of air under pressure from said source of air pressure and through said conveying means to each of said pneumatic piston and cylinder assemblies.

8. The apparatus as set forth in claim 1 including means for maintaining in concert pivotal extension and retraction of said pair of pontoons.

9. Apparatus for varying the wetted surface of a water borne vessel, said apparatus comprising in combination:

a) a pair of pontoons, each pontoon of said pair of pontoons being asymmetrical and including a plurality of longitudinally extending surfaces with certain ones of said surfaces having a planar section and a simple curvature curved section and the remaining ones of said surfaces being planar, each of said surfaces being set at an angle with respect to an adjacent one of said surfaces;

b) means for pivotally attaching each pontoon of said pair of pontoons to the vessel;

c) means for urging pivotal movement of each pontoon of said pair of pontoons about its respective attaching means to extend and to retract said pair of pontoons to place a selected one of said surfaces of each pontoon of said pair of pontoons lowermost in the water and present a unique wetted area as a function of the degree of extension of said pair of pontoons, said urging means including at least a pair of anchor points disposed upon the vessel associated with each pontoon of said pair of pontoons;

d) means for relocating said pairs of anchor points to modify the extension and the retraction of each pontoon of said pair of pontoons;

e) a source of power for actuating said relocating means to selectively relocate each of said pairs of anchor points as a function of the degree of extension and retraction of said pair of pontoons which relocation places a different one of said surfaces of each pontoon of said pair of pontoons as the lowermost surface in the water and thereby alter the wetted area to conform with speed of the vessel and with the water surface condition; and f) means for maintaining in concert pivotal extension and retraction of said pair of pontoons, said maintaining means including a cable extending from each pontoon to a reel and means for urging synchronous rotation of said pair of reels.

10. The apparatus as set forth in claim 9 including motive means for urging and restraining rotation of said pair of reels.

11. Apparatus pivotally attached to a water vessel for supporting the water vessel upon water, said apparatus comprising in combination:

a) a pair of asymmetric pontoons, each pontoon of said pair of pontoons including a first plurality of planar longitudinally extending surfaces and a second plurality of surfaces having a planar section and a forward tapering single curvature curved section to define the bow of the pontoon;

b) means for pivotally attaching each portion of said pair of pontoons to the water vessel; and c) means for pivoting each pontoon of said pair of pontoons to present selected ones of said first and second plurality of surfaces as the lowermost surface in contact with the water and present a pontoon cross section in the water commensurate with the speed of the vessel and the water surface conditions to optimize smoothness and steadiness of the vessel when underway.

12. The apparatus as set forth in claim 11 including means for actuating said pivoting means while the vessel is underway.

13. The apparatus as set forth in claim 11 wherein each pontoon of said pair of pontoons includes a widest surface positionable as the lower most surface when said pair of pontoons are retracted to minimize the draft of the vessel.

14. The apparatus as set forth in claim 11 wherein each pontoon of said pair of pontoons includes a narrowest surface positionable as the lower most surface when said pair of pontoons are extended to encourage high speed planing.

15. The apparatus as set forth in claim 11 wherein each pontoon of said pair of pontoons includes a reinforced surface positionable as the lower most surface for accommodating contact with the shore when said pair of pontoons are at an intermediate extended position.

16. The apparatus as set forth in claim 15 wherein each pontoon of said pair of pontoons includes a widest surface positionable as the lower most surface when said pair of pontoons are retracted to minimize the draft of the vessel.

17. The apparatus as set forth in claim 16 wherein each pontoon of said pair of pontoons includes a narrowest surface positionable as its lower most surface when said pair of pontoons are extended to encourage high speed planing.

18. The apparatus as set forth in claim 11 including means for synchronizing pivotal movement of said pair of pontoons, said synchronizing means including a cable extending from each pontoon of said pair of pontoons to an associated reel and means for rotating said reels in concert.

19. The apparatus as set forth in claim 11 including means for pivoting said pair of pontoons and motive power means for modifying the pivotal position of said pair of pontoons established by said pivoting means.

* * * * *